United States Patent [19]

Garside

[11] 4,407,144

[45] Oct. 4, 1983

[54] STORAGE CHAMBER WITH EXPENDABLE REFRIGERATION SYSTEM

[75] Inventor: David Garside, Quebec, Canada

[73] Assignee: Concool International Ltd., Georgetown, Cayman Islands

[21] Appl. No.: 324,987

[22] Filed: Nov. 25, 1981

[30] Foreign Application Priority Data

Nov. 28, 1980 [GB] United Kingdom ..... 8038314

[51] Int. Cl.[3] ..... F25D 3/12

[52] U.S. Cl. ..... 62/384; 62/239; 62/440

[58] Field of Search ..... 62/51, 52, 239, 388, 62/405, 440, 384, 385, 387

[56] References Cited

U.S. PATENT DOCUMENTS

| | | | |
|---|---|---|---|
| 927,595 | 7/1909 | Place . | |
| 1,847,321 | 3/1932 | Wetmore . | |
| 2,030,005 | 2/1936 | Kellogg | 62/91.5 |
| 2,502,192 | 3/1950 | Williamson | 62/384 X |
| 2,636,357 | 4/1953 | Woods | 62/384 X |
| 2,791,888 | 5/1957 | Vani | 62/384 |
| 2,948,123 | 8/1960 | Morrison | 62/64 |
| 3,241,329 | 3/1966 | Fritch, Jr. et al. | 62/239 X |
| 3,283,530 | 11/1966 | Byane et al. | 62/389 |
| 3,410,109 | 11/1968 | Maryland | 62/45 |
| 3,633,381 | 1/1972 | Haff et al. | 62/222 |
| 4,129,432 | 12/1978 | Garside | 62/223 |

FOREIGN PATENT DOCUMENTS

| | | | |
|---|---|---|---|
| 1048803 | 2/1979 | Canada | 62/223 |

*Primary Examiner*—Lloyd L. King
*Attorney, Agent, or Firm*—Larson and Taylor

[57] ABSTRACT

A self contained refrigerated shipping or storage container utilizing liquid carbon dioxide is disclosed. The container utilizes a network of liquid containing units arranged to allow maximum useful storage space with maximum cooling. The container is insulated and has four walls, at least one of which has at least one access door therein, a floor and a roof, with a pressurized liquid carbon dioxide reservoir having a workable heat exchange relationship with the interior of the container. The reservoir includes a gaseous space with a vent from the space having a pressure relief valve therein adapted to maintain a substantially constant pressure in the reservoir such that the temperature of the liquid carbon dioxide in the reservoir is controlled. The improvement wherein the liquid carbon dioxide reservoir comprises a network of linked liquid containing units with horizontal units in the floor of the container connected to at least one vertical riser unit in at least one wall of the container, the vertical riser unit being connected to vent via the pressure relief valve.

14 Claims, 4 Drawing Figures

STORAGE CHAMBER WITH EXPENDABLE REFRIGERATION SYSTEM

The present invention relates to refrigerated storage chambers and shipping containers. More specifically, the present invention includes storage chambers, specifically shipping containers, which utilize liquid carbon dioxide contained in a pressurized reservoir system within the chamber for cooling.

An expendable refrigeration system is disclosed in my U.S. Pat. No. 4,129,432, which issued Dec. 12, 1978. The system utilizes the concept of a liquid coolant storage reservoir being kept at a cold temperature and withdrawing heat from a storage chamber. The pressurized uninsulated liquid carbon dioxide storage reservoir is within the storage chamber and has a vent from a gaseous space in the liquid storage reservoir. A pressure relief valve is installed in the vent adapted to maintain a substantially constant pressure within the liquid storage reservoir, such that the temperature of the liquid carbon dioxide within the storage reservoir is controlled. The temperature of the liquid carbon dioxide within the reservoir is kept within the range of approximately −24° to +5° C. and the temperature within the storage area of the chamber is generally slightly above the temperature of the liquid carbon dioxide.

I have found that whereas the system disclosed and claimed in my previous patent works satisfactorily, more even temperatures may be obtained by providing a pressurized liquid carbon dioxide storage reservoir in the form of a network of linked liquid containing units within the storage chamber. Such a system is applicable for shipping containers to ensure that the maximum useful storage space within the container is available for storing the refrigerated products. A network of liquid containing units can store as much liquid as a single storage tank. By incorporating liquid containing horizontal units in the floor of the chamber which connect to vertical riser units in at least one wall of the chamber the cold liquid carbon dioxide has an increased workable heat exchange relationship with the interior of the chamber to ensure more even cooling within the chamber. In some cases roof pipes may also be included which connect to the vertical riser units and contain liquid carbon dioxide thus providing another cooling surface in the chamber.

In another embodiment I have found that by incorporating at least one large cross section reservoir tank in at least one wall of a shipping container having a connection to a network of liquid containing horizontal units and vertical riser units formed of pipes in the floor and at least one of the other walls of the container, a self contained cold storage unit is provided which has almost the same storage width and height as an insulated container. Furthermore, if the large cross section reservoir tank in the wall is completely insulated a shut-off valve may be provided in the liquid connection to the network of pipes, so when the container is not in use the shut-off valve is closed and the liquid carbon dioxide remains in the large cross section reservoir tank with minimum evaporation loss. In another embodiment a pump, preferably powered by the vent gas from the reservoir, maintains the carbon dioxide liquid in the vertical riser units of the container, thus ensuring that maximum cooling is obtained within the container.

The present invention provides in combination, an insulated storage chamber having four walls, at least one of which has at least one access door therein, a floor and a roof, with a pressurized liquid carbon dioxide reservoir having a workable heat exchange relationship with the interior of the chamber, the reservoir including a gaseous space with a vent from the gaseous space having a pressure relief valve therein adapted to maintain a substantially constant pressure in the reservoir such that the temperature of the liquid carbon dioxide in the reservoir is controlled, the improvement wherein the liquid carbon dioxide reservoir comprises a network of linked liquid containing units with horizontal units in the floor of the chamber connected to at least one vertical riser unit in at least one wall of the chamber, the vertical riser unit being connected to vent via the pressure relief valve.

In an embodiment of the invention, the liquid carbon dioxide reservoir comprises at least one large cross section reservoir tank in at least one wall of the chamber, the reservoir tank having a liquid connection to pipes forming the network of the horizontal units and at least one vertical riser unit, and including a gas return line from the vertical riser unit leading to the gaseous space in the reservoir tank, the vent via the pressure relief valve connected to the gaseous space in the reservoir tank. In this embodiment a shut-off valve may be provided in the liquid connection between the reservoir tank and the network, and the reservoir tank may be completely insulated and only the network of the horizontal units and vertical riser units have a workable heat exchange relationship with the interior of the chamber. A pump means may be provided in the liquid connection from the reservoir tank to the network adapted to maintain a high liquid level in the vertical riser units and in some cases in roof pipes positioned below the gas return line. The pump is preferably powered by gas leaving the gaseous space in the reservoir tank through the vent.

In other embodiments the linked liquid container units are cylinders joined together by pipes, or may be formed entirely of pipes which have different cross sections.

In drawings which illustrate embodiments of the invention,

Figure 1:
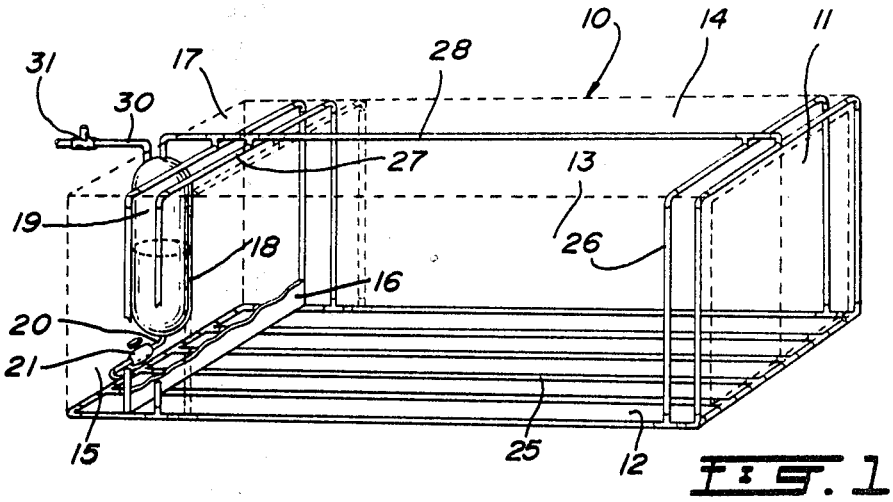
FIG. 1 is an isometric view of an insulated shipping container having a liquid carbon dioxide cooling system according to one embodiment of the present invention.

Referring now to FIG. 1, a shipping container 10 is illustrated having access doors 11 at one end, a floor 12, two side walls 13, a roof 14 and an end wall 15. The end wall 15 has a bulkhead 16 forming a space 17 which contains a vertical large cross sectional pressurized reservoir tank 18 to contain liquid carbon dioxide with a gaseous space 19 above the liquid level. At the bottom of the tank 18 is a connector line 20 to a network of linked liquid containing units so the tank and network form a common reservoir system. The connector line 20 has a shut-off valve 21 so the liquid carbon dioxide can be contained within the tank 18 and not flow into the network.

The network includes horizontal pipes 25 which extend in the floor 12 of the container, vertical riser pipes 26 which extend up the side walls 13 of the container, and horizontal roof pipes 27 extending across the roof and having connections to a gas return line 28 which is located at a higher level than the roof pipes 27 and connects into the gaseous space 19 at the top of the tank 18. All of the pipes in the network, except the gas return line 28, are in a workable heat exchange relationship with the interior of the container. When the shut-off valve 21 is opened, liquid carbon dioxide from the tank 18 flows into the network of pipes and up the vertical riser pipes 26 until the liquid is level throughout the network. A vent line 30 from the gaseous space 19 in the tank 18 has a pressure relief valve 31 set to a specific pressure to control the pressure in the tank and network and the temperature of the liquid carbon dioxide within the tank and the network. For example, if the pressure within the tank and network is controlled to 300 lbs/sq. inch, the temperature of the liquid is approximately −17° C. The pressure throughout the tank and network is constant, heat from the interior of the container and heat that passes through the walls, floor and roof of the container heats up the liquid carbon dioxide in the tank and network causing evaporation of the liquid. As the liquid and gas within the tank and network remain at a constant pressure, the gas escapes and the heat is absorbed by the latent heat of vaporization. The escaping carbon dioxide gas rises up the vertical pipes 26 above the liquid level and passes along the roof pipes 27 and the gas return line 28 to the gaseous space 19 in the tank, and then escapes through the vent line 30 via the pressure relief valve 31.

In one embodiment the bulk head 16 separating the tank 18 from the interior of the container 10 is fully insulated, thus when the shut-off valve 21 is turned off, even though the interior of the container warms up, there is minimum evaporation of the liquid carbon dioxide from within the tank 18, which preserves most of the unused liquid carbon dioxide, and the container can be cooled at a later time by merely opening the shut-off valve 21.

Figure 2:
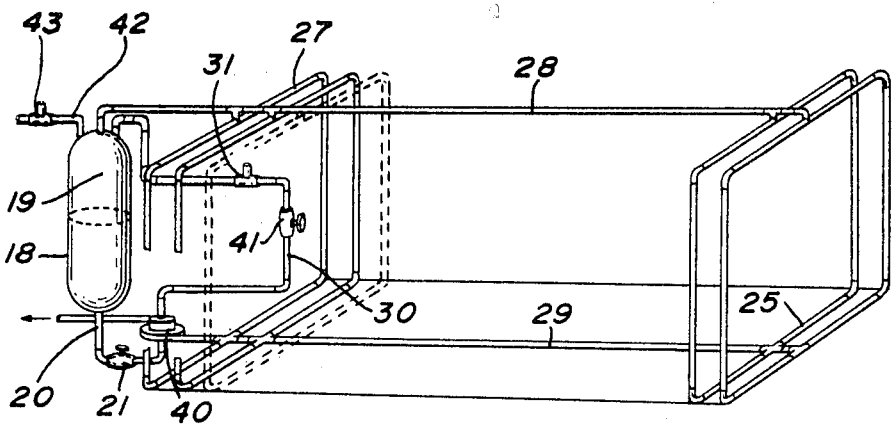
FIG. 2 is an isometric view of another embodiment of a liquid carbon dioxide cooling system in a shipping container.

As the liquid level in the tank 18 drops, so does it drop in the vertical riser pipes 26 and the majority of cooling then occurs from the horizontal pipes 25 in the floor 12. A further embodiment is shown in FIG. 2 wherein the gas flowing through the pressure relief valve 31 and vent line 30 from the tank 18 drives a pump 40 in the liquid connection line 20 from the tank 18 to the network. The pump 40 maintains the level of the liquid carbon dioxide in the vertical riser pipes 26 to a desired height. In some instances liquid carbon dioxide may be maintained in the roof pipes 27. A shut-off valve 41 is provided in the vent line 30 to turn off the pump 40 when the liquid level reaches the desired height. Thus, in this manner, even when the level of liquid carbon dioxide in the tank 18 drops, the liquid level in the vertical riser pipes 26 and in some instances the roof pipes 27, is still maintained and more efficient cooling of the interior of the container occurs. A second vent line 42 from the tank 18 is provided with a pressure relief valve 43 set at a slightly higher pressure than the pressure relief valve 31 in line 30 leading to pump 40. Thus, when the shut-off valve 41 in the vent line 30 is closed, and the pump 40 does not operate, the gaseous carbon dioxide may still vent from the system, and the temperature of the liquid carbon dioxide in the tank and network is maintained at close to the preferred level. In one embodiment the control for the liquid level in the vertical riser pipes 26 is a sensing switch to sense the liquid level in one or more vertical riser pipes 26 or roof pipes 27 and utilize a pressure control system of liquid carbon dioxide gas to switch the pump 40 on and off to maintain that level. In this system the pump 40 also acts as a non return valve preventing liquid carbon dioxide flowing back into the tank 18.

In FIG. 1 the horizontal pipes 25 in the floor 12 extend longitudinally for the length of the container 10, and in FIG. 2 the horizontal pipes 25 extend across the width of the floor 12 and each horizontal pipe 25 joins to a vertical riser pipe 26. A central liquid line 29 in the floor 12 supplies liquid carbon dioxide to each horizontal pipe 25. These figures show two embodiments, other embodiments having different pipe arrangements to make up the network may be provided.

An embodiment that may be utilized for a container is to have a number of cylinders linked together and horizontally located across the floor of the chamber with a workable heat exchange relationship between the surface of the cylinders and the floor of the chamber. One or two vertical riser units in the form of pipes extend up at least one side of the chamber which allow gas to escape to vent through a pressure relief valve. In another embodiment a large vertical reservoir tank may be connected to a network of pipes in the floor of the chamber with a single vertical riser pipe connecting the gaseous space above the liquid level in the reservoir tank.

Figure 3:
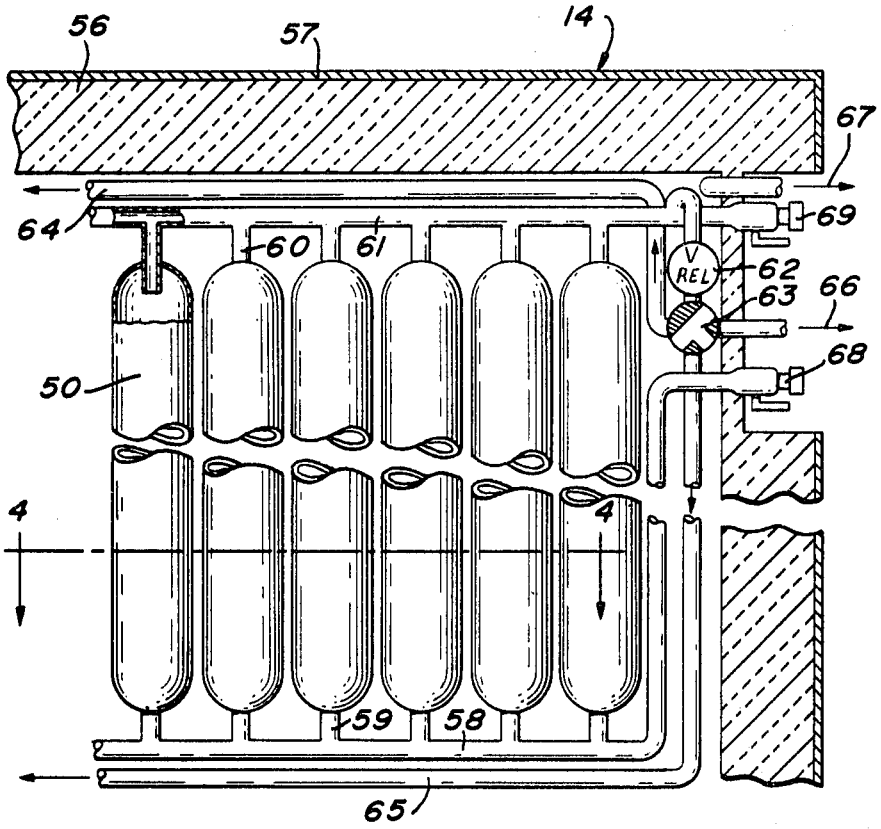
FIG. 3 is a partial cross sectional side elevational view through a shipping container having a plurality of vertical cylinders forming liquid carbon dioxide reservoirs therein.
Figure 4:
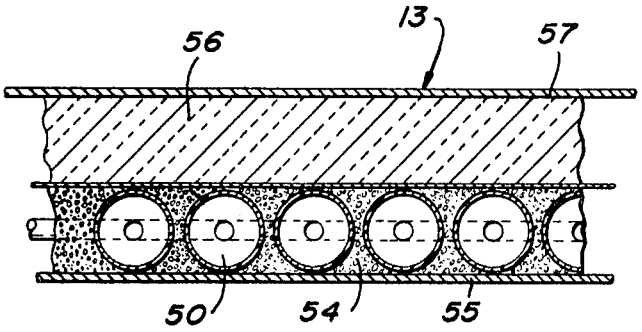
FIG. 4 is a partial cross sectional plan view taken at 4—4 of FIG. 3.

A cross section through a side of a container is shown in FIG. 3 specifically illustrating the vertical riser units 26 in one wall 13 of a container. Vertical riser units 26 are cylinders 50 encapsulated in a non-insulating material 54 as illustrated in FIG. 4 to form a sandwich panel. The inside wall 55 of the panel is also non-insulating so that there is a workable heat exchange relationship between the cylinders 50, the inside wall 55, and the interior of the container. The inside wall 55 is a smooth wall presenting a flat surface for ease in loading the container. The panel provides support and protection for the cylinders and is esthetically more pleasing and easier to clean. The inside wall may be made of metal which provides a good heat conductor, and be in sheet form, or spaced apart strips. Insulation 56 is provided on the outside of the cylinders 50 which in turn has a protective outside wall 57 to protect the container. Whereas FIG. 4 illustrates a side wall, it will be appreciated that the sandwich panel construction may be incorporated in an end wall, floor, or roof, as desired.

The cylinders 50 are filled by a liquid manifold line 58 at the bottom of the container and liquid connector lines 59 to each cylinder 50. A gas connector line 60 from the top of each cylinder 50 feeds to a gas manifold line 61 which is connected to vent. The gas manifold line 61 has a pressure relief valve 62 set to the desired pressure, followed by a three-way valve 63 which allows an operator to select one of three vents. An upper container vent line 64 wherein the gas is vented to the top of the interior of the container, a lower container vent line 65 wherein the gas is vented to the bottom of the interior of the container, or an outside vent 66 wherein the gas is vented outside the container. A vent 67 is provided from the interior of the container to prevent a build up of pressure in the container.

A liquid connector 68 is provided connected to the liquid manifold line 58 to fill the cylinders 50 and a gas connector 69 is provided connected to the gas manifold line 61, upstream of the pressure relief valve 62. The connectors 68,69 allow containers to be ganged together or temporarily connected to a main line from a liquid carbon dioxide storage tank to permit manual or automatic refilling.

The reservoir in the form of a network of pipelines, cylinders, tanks and the like, is specifically formed to allow liquid carbon dioxide to be maintained around the container and in a workable heat exchange relationship with the interior of the container. In this manner, the cargo is isolated from heat intrusion. Whereas the drawings illustrate a shipping container having access doors at one end, in some containers access doors may be provided in the centre or at any location in a side wall or even a roof. In such a case, the network of pipes is located so that it does not interfere with the access doors.

Changes may be made without departing from the scope of the present invention, which is limited only by the claims.

The embodiments of the invention in which an exclusive property or privilege is claimed are defined as follows:

1. In a refrigerated storage container including: an insulated storage chamber having four walls, at least one of which has at least one access door therein, a floor and a roof; a pressurized liquid carbon dioxide reservoir in a direct heat exchange relationship with the interior of the chamber, the reservoir including an upper gaseous space and a vent from the gaseous space having a pressure relief valve therein adapted to maintain a substantially constant pressure in the reservoir such that the temperature of the liquid carbon dioxide in the reservoir is controlled;

the improvement wherein the liquid carbon dioxide reservoir comprises a network of linked liquid containing units including horizontal units in the floor of the chamber being filled with liquid carbon dioxide and connected to at least one vertical riser unit in at least one wall of the chamber, the vertical riser unit being at least partially filled with liquid carbon dioxide and being connected to vent heat generated carbon dioxide gases via the pressure relief valve.

2. The combination according to claim 1 wherein the liquid carbon dioxide reservoir comprises at least one large cross section reservoir tank in at least one wall of the chamber, the reservoir tank having a liquid connection to pipes forming the network of the horizontal units and at least one vertical riser unit and including a gas return line from the vertical riser unit leading to the gaseous space in the reservoir tank, the vent via the pressure relief valve connected to the gaseous space in the reservoir tank.

3. The combination according to claim 2 wherein a shut-off valve is included in the liquid connection between the reservoir tank and the network.

4. The combination according to claim 3 wherein the reservoir tank is completely insulated and only the network of the horizontal units and vertical riser units have a workable heat exchange relationship with the interior of the chamber.

5. The combination according to claim 2 wherein the storage chamber is a shipping container having a reservoir tank in at least one wall and the vertical riser units in at least one of the other walls.

6. The combination according to claim 2 including a pump means in the liquid connection from the reservoir tank to the network adapted to maintain a desired liquid level in the vertical riser units.

7. The combination according to claim 6 wherein the pump means is powered by gas leaving the gaseous space in the reservoir tank through the vent.

8. The combination according to claim 6 wherein the pump means maintains the liquid level in roof pipes connected to the vertical riser units positioned beneath the gas return line and connected thereto.

9. The combination according to claim 1 wherein the linked liquid container units are cylinders joined together by pipes.

10. The combination according to claim 1 wherein the network of linked liquid containing units is formed of pipes.

11. The combination according to claim 10 wherein the pipes are of different cross sections.

12. The combination according to any one of claims 1, 9 or 10 including a three-way venting system to allow gas to vent to the top of the chamber interior, the bottom of the chamber interior or outside the chamber.

13. The combination according to claim 9 wherein the cylinders are encapsulated within sandwich panels to form the floor and sides of the chamber.

14. The combination according to claim 1 including a liquid connection means to replenish liquid carbon dioxide in the reservoir and a connection means from the gaseous space of the reservoir.

* * * * *